US006151807A

United States Patent [19]

Qui et al.

[11] Patent Number: 6,151,807

[45] Date of Patent: Nov. 28, 2000

[54] HEALTH CARE SHOE

[76] Inventors: Yi-Ming Qui; David Liu; Joanne Yang, all of 1177 S. Jellick Ave., City of Industry, Calif. 91748

[21] Appl. No.: 09/240,791

[22] Filed: Jan. 30, 1999

[51] Int. Cl.[7] ..... A61F 5/14; A13B 7/06

[52] U.S. Cl. ..... 36/140; 36/3 B; 36/3 R

[58] Field of Search ..... 36/141, 140, 3 R, 36/3 B

[56] References Cited

U.S. PATENT DOCUMENTS

| | | |
|---|---|---|
| 4,020,569 | 5/1977 | Fukuoka . |
| 4,033,054 | 7/1977 | Fukuoka . |
| 4,079,526 | 3/1978 | Fukuoka . |
| 4,109,661 | 8/1978 | Fukuoka . |
| 4,130,950 | 12/1978 | Bazzle et al. . |
| 5,233,768 | 8/1993 | Humphreys . |
| 5,976,100 | 11/1999 | Greenawalt . |

*Primary Examiner*—Ted Kavanaugh
*Attorney, Agent, or Firm*—Raymond Y. Chan; David and Raymond

[57] ABSTRACT

A health care shoe, which can continuously provide adequate magnetic field arranged to penetrate through the wearer's foot for improving the wearer's blood circulation and metabolism, includes a sole having a plurality of magnet cavities specifically indented and distributed on an inner surface thereof, a shoe body which includes a vamp and sides rigidly attached on top of the sole to define a foot chamber between the shoe body and the sole; an insole placed on the sole inside the foot chamber; a plurality of base magnet elements fittingly received in the magnet cavities respectively; and a plurality of upper magnet elements embedded inside the shoe body with respect to the positions of the base magnet elements, wherein the upper magnet elements are arranged to enable magnetic fields flowing between the base magnet elements and the upper magnet elements. Moreover, the sole further has at least a medicine receiving cavity to receive a medicine unit which contains a medicine tablet made of painkiller or Chinese medical herb being incased therein. The medicine unit further includes a bottom magnet element positioned thereunder so as to produce magnetic filed around the medicine unit.

16 Claims, 5 Drawing Sheets

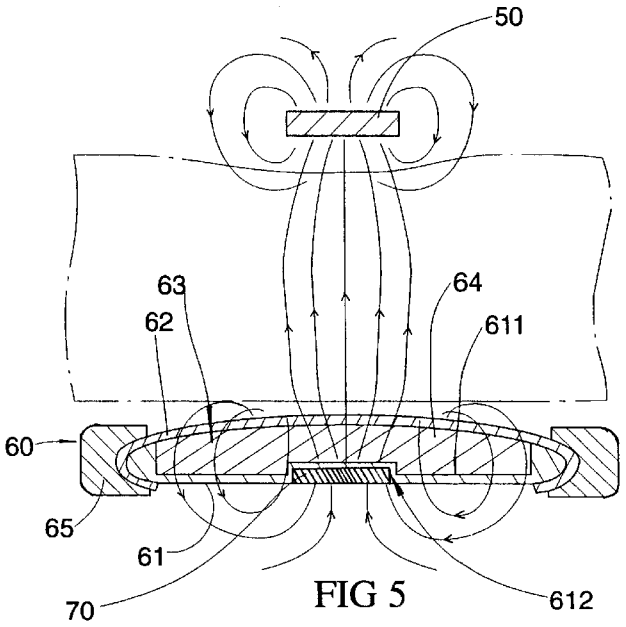
FIG 5
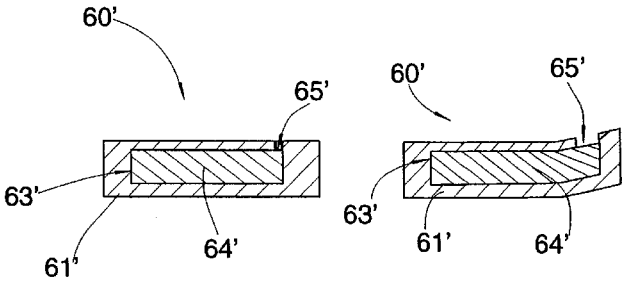
FIG 6B
FIG 6A
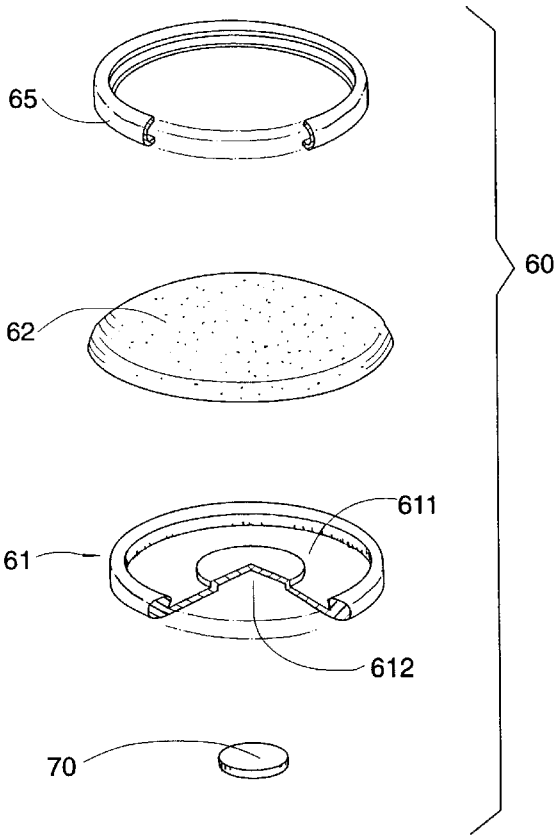
FIG 4

HEALTH CARE SHOE

FIELD OF THE PRESENT INVENTION

The present invention relates to shoes, and more particularly to a health care shoe which can provide a magnetic field penetrating through a human foot for improving the wearer's blood circulation and metabolism, and for enhancing the medicine volatilized from medicine unit installed on the shoe sole to permeate through the skin and be absorbed by the wearer's foot.

BACKGROUND OF THE PRESENT INVENTION

Nowadays, scientists have proved that blood circulation of human foot has been playing a very important part of the human body blood circulation system which cannot be forfeited. The distribution of nervous of the human foot has a very close relationship with the nervous of other organs that can affect the cell reproduction of the nervous of other organs and normal operation. The knowledge of human health has been increased for the past few years. Although many foot protection materials have been marketed, not so many of these inventions can meet the overall requirement of the health protection concept.

It is a fact that a normal person will wear shoes for at least eight hours. Therefore shoe having health care function can help the wearer improving his or her health. For examples, U.S. Pat. No. 5,694,705 discloses a therapeutic insole for footwear; U.S. Pat. No. 5,491,909 discloses a shock absorbing medical shoe; U.S. Pat. No. 5,689,902 shows footwear for doing exercise and messaging.

It is well known that through the static and dynamic magnetic effect, the quality and quantity of the biological electricity in a human body will change, so that a micro electrical current will form that may change the concentration and active speed of the ions and generate limited heat to enhance the blood circulation and accelerate the body biological reaction. Although some prior arts incorporate magnets in the sole or insole structure for providing magnetic field around the wearer's foot, such as U.S. Pat. No. 5,553,398 which suggests an elastically resilient shoe insole having a nubbed surface and a magnetic heads fastened on the baseplate thereof, such magnetic field, which is formed around the wearer's foot and produced by the magnets placed in the sole or on the insole, in fact, does not normally consider strong enough to permeate the human body to cause the above health benefits unless body penetrating magnetic field can be produced.

SUMMARY OF THE PRESENT INVENTION

It is a main object of the present invention to provide a health care shoe that continuously provides adequate magnetic field arranged to penetrate through the wearer's foot for improving the wearer's blood circulation and metabolism.

It is another object of the present invention to provide a health care shoe that forms a body penetrative magnetic field for enhancing the medicine, which is volatilized from medicine unit installed on the shoe sole, to permeate through the skin and be absorbed by the wearer's foot.

It is another object of the present invention to provide a health care shoe having a plurality of magnet elements attached to the sole, padding or insole, vamp and both sides of the shoe for producing penetrative magnetic fields within the interior foot receiving chamber of the shoe that can cause chemical reaction of nervous of human foot.

It is another object of the present invention to provide a health care shoe having at least a medicine unit installed in the sole or the insole, wherein the permeability of the medicine volatized from a medicine unit is further enhanced by a specific magnet attached under the medicine unit.

Accordingly, in order to accomplish the above objects, the present invention provides a health care shoe which comprises:

- a sole having a plurality of magnet cavities specifically indented and distributed on an inner surface thereof;
- a shoe body which comprises a vamp and sides rigidly attached on top of the sole to define a foot chamber between the shoe body and the sole;
- an insole placed on the sole inside the foot chamber;
- a plurality of base magnet elements fittingly received in the magnet cavities respectively; and
- a plurality of upper magnet elements embedded inside the shoe body with respect to the positions of the base magnet elements, wherein the upper magnet elements are arranged to enable magnetic fields flowing between the base magnet elements and the upper magnet elements.

Moreover, according to a preferred embodiment of the present invention, the sole further has at least a medicine receiving cavity to receive a medicine unit which contains a medicine tablet made of painkiller or Chinese medical herb being incased therein. The medicine unit further comprises a bottom magnet element positioned thereunder so as to produce magnetic filed around the medicine unit.

BRIEF DESCRIPTION OF THE DRAWINGS

FIG. 4 is an exploded perspective view of the medicine unit of the health care shoe according to the above preferred embodiment of the present invention.

FIG. 5 is a sectional schematic view illustrating the magnetic field distributed between an upper magnet element and the bottom magnet element of a medicine unit according to the above preferred embodiment of the present invention.

FIGS. 6A and 6B are sectional view of a pad-form medicine unit according to the above preferred embodiment of the present invention.

DETAILED DESCRIPTION OF THE PREFERRED EMBODIMENT

Figure 1:
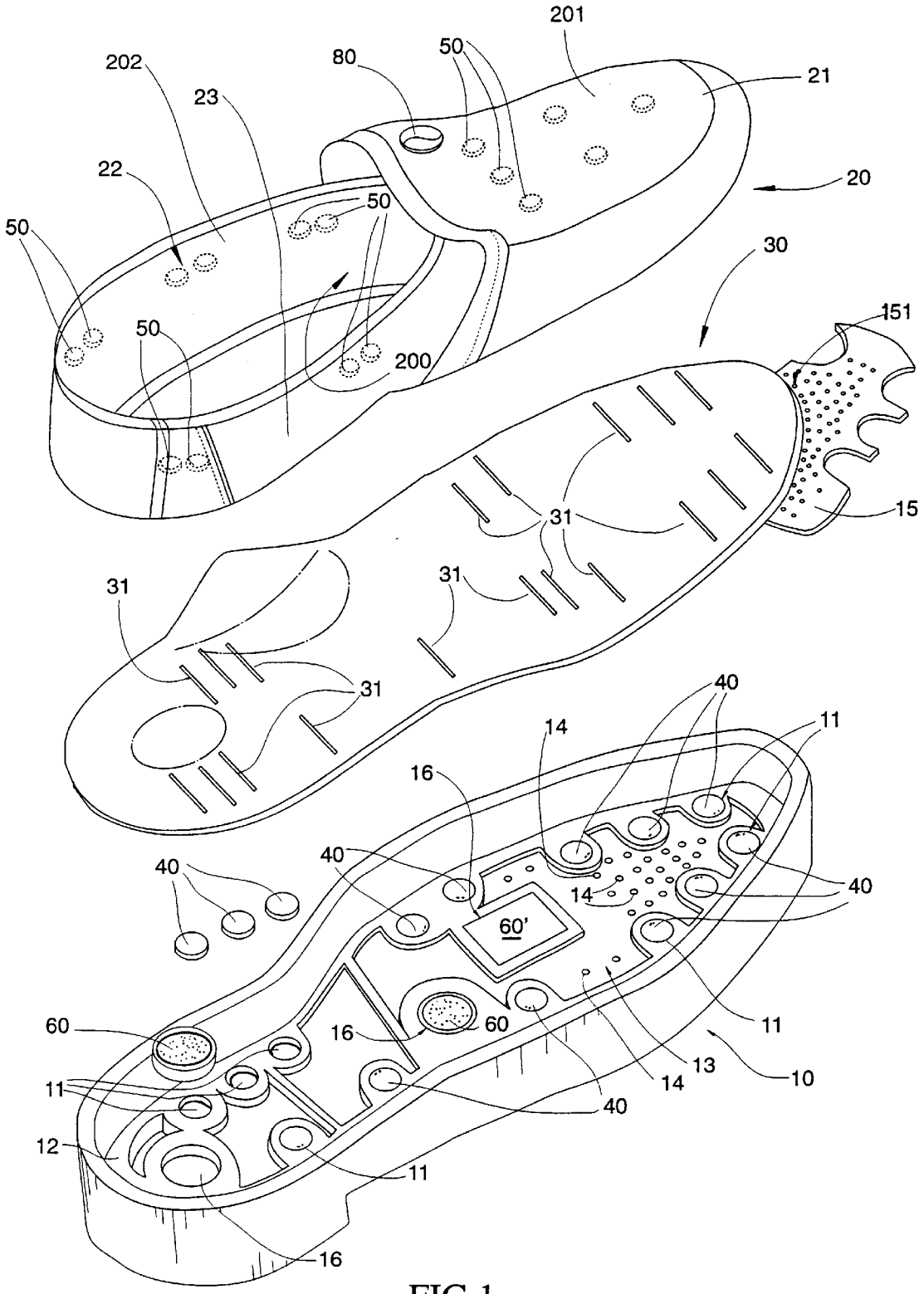
FIG. 1 is an exploded perspective view of a health care shoe according to a preferred embodiment of the present invention.
Figure 2:
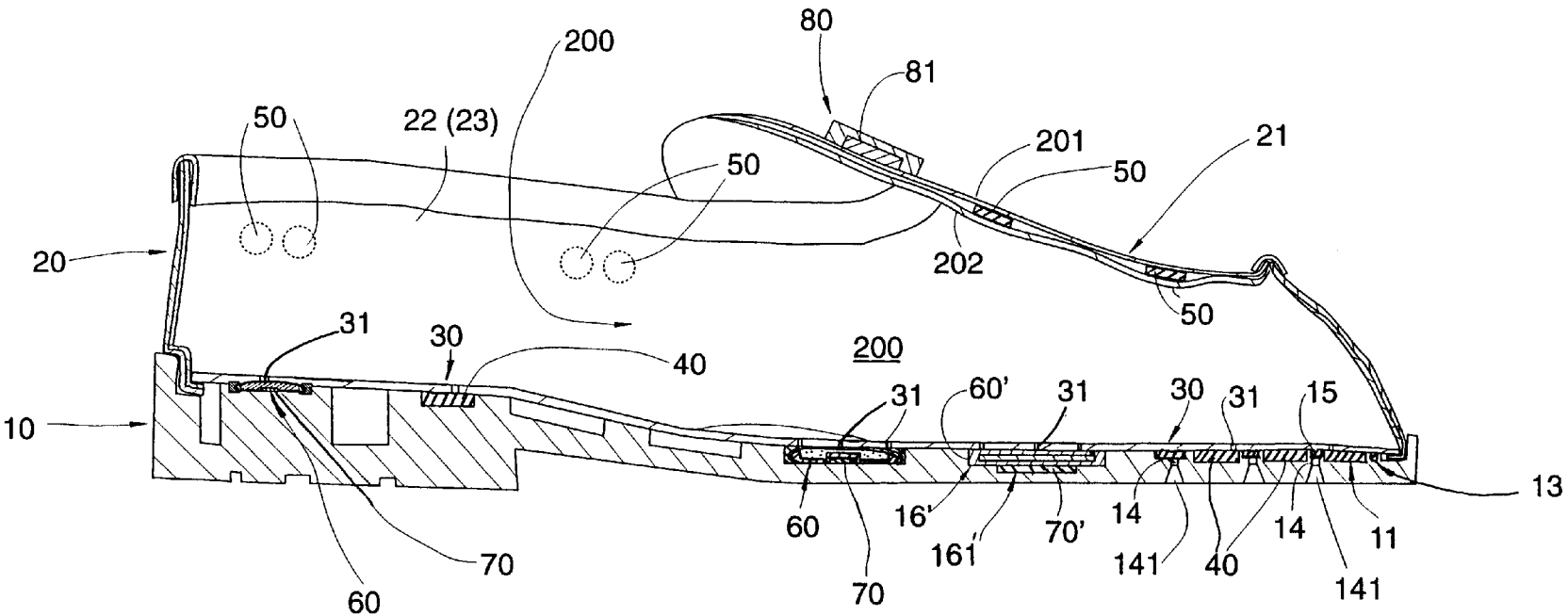
FIG. 2 is a sectional view of the health care shoe according to the above preferred embodiment of the present invention.

Referring to FIGS. 1 and 2, a health care shoe according to a preferred embodiment of the present invention is illustrated, which comprises a sole 10, a shoe body 20, an insole 30, a plurality of base magnet elements 40, and a plurality of upper magnet element 50.

The sole 10 has a plurality of magnet cavities 11 specifically indented and distributed on an inner surface 12 thereof. Each of the magnet cavities 11 is preferably in circular shape and each of the base magnets 40 is also made in tablet-shape having a size equal to or slightly smaller than the respective magnet cavity 11. The plurality of base magnet elements 40 are fittingly received in the magnet cavities 11 respectively, wherein glue may be applied to firmly stick the base magnet elements 40 in the magnet cavities II respectively.

The shoe body 20 comprises a vamp piece 21 and side pieces 22, 23 which are rigidly attached on top of the sole 10 to define a foot chamber 200 between the shoe body 20 and the sole 10. The vamp piece 21 and the side pieces 22, 23 each comprises a leather surface 201 and an interior lining 202 adhered together. The vamp piece 21 and the side pieces 22, 23 are sewed together to form the shoe body 20.

As shown in FIGS. I and 2, the upper magnet elements 50 each having a circular shape are embedded inside the vamp piece 21 and the side pieces 22, 23 of the shoe body 20 with respect to the positions of the base magnet elements 40 located on the sole 10. In other words, the plurality of upper magnet elements 50 are placed between the leather surface 201 and the interior lining 202 of the shoe body 20.

As shown in FIG. 2, each of the upper magnet elements 50 is preferably glued to the interior lining 202 of the shoe body 20. Of course, the upper magnet elements 50 can also be glued to the inner side of the leather surface 201. Practically, it is better to press indenting grooves on the inner side of the leather surface 201 to fittingly hold the upper magnet elements 50 respectively.

Figure 7:
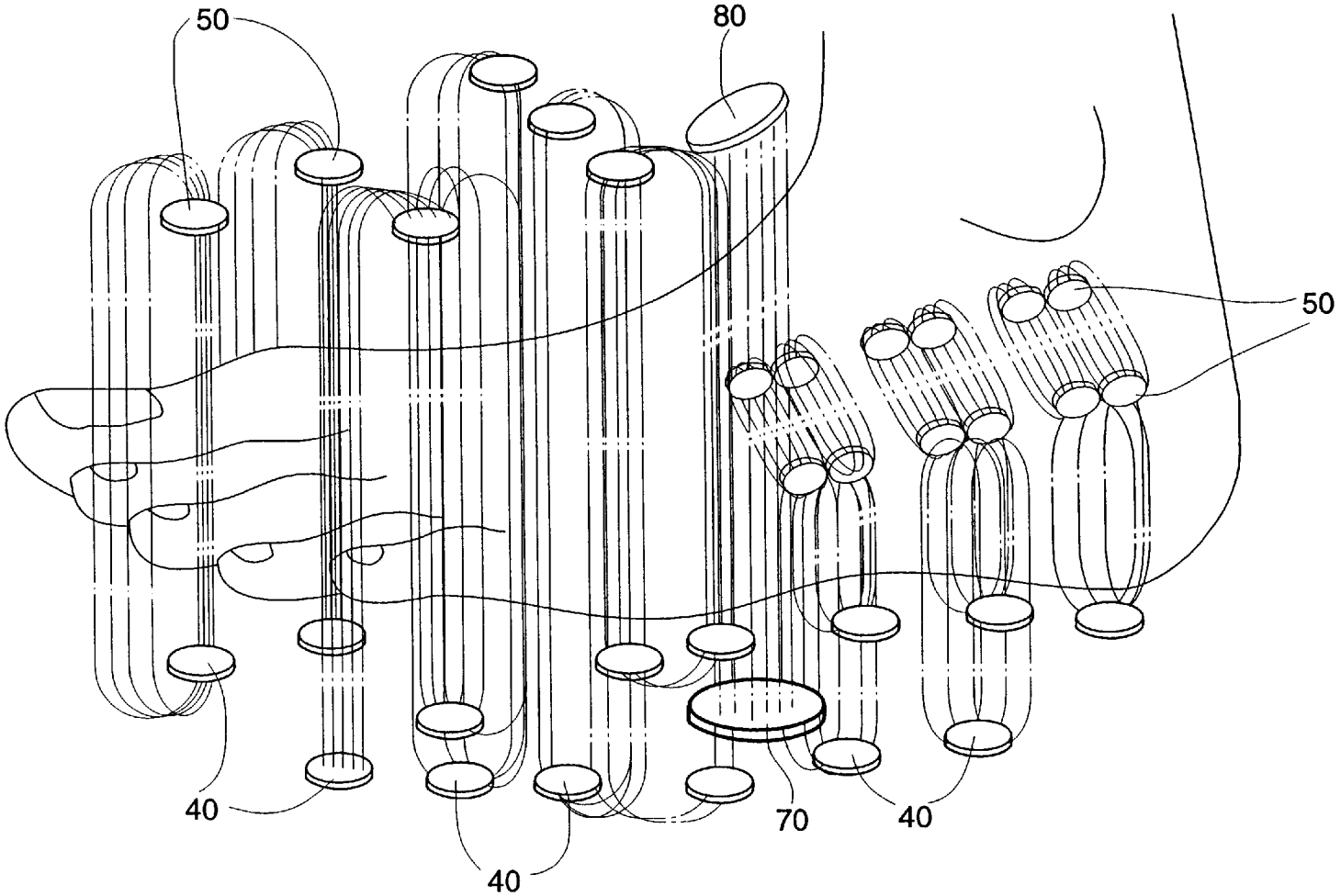
FIG. 7 is a schematic view illustrating the magnetic field distribution around the wearer's foot according to the above preferred embodiment of the present invention.

As shown in FIGS. 5 and 7, the upper magnet elements 50 installed in the vamp piece 21 of the shoe body 20 are arranged to enable magnetic fields flowing between the base magnet elements 40 and the upper magnet elements 50. As shown in FIGS. 1, 2 and 7, it should be noted that the upper magnet elements 50 embedded inside the two confronting side pieces 22, 23 will constitute transversal magnetic field therebetween for penetrating through the portion below the medial malleolus of the wearer's foot.

According to the present embodiment, as shown in FIGS. 1 and 2, a front half of the sole 10 forms a ventilation groove 13 and provides a plurality of air ventilation holes 14 distributed on the ventilation groove 13. Each of the air holes 14 has an enlarged base end 141 (as shown in FIG. 2). The sole 10 further comprises an elastic ventilation pad 15 which has plenty of ventilation holes 151 thereon and is made of water resistant rubber material. The elastic ventilation pad 15 is shaped and sized to fittedly attached in the ventilation groove 13. Therefore, when the wearer of the health care shoe of the present invention walks, the elastic ventilation pad 15 helps to press the dirty air exit the foot chamber 200 through the air holes 14 and suck in fresh air outside.

Moreover, according to the present invention, the sole 10 further has at least a medicine receiving cavity 16 to fittingly receive a medicine unit 60 which contains a medicine tablet made of painkiller or Chinese medical herb being incased therein. The medicine unit 60 further comprises a bottom magnet element 70 positioned thereunder so as to produce magnetic filed around the medicine unit 60.

As shown in FIGS. 1 and 2, the insole 30 is placed on the sole 10 inside the foot chamber 200, wherein a plurality of small ventilators 31 are formed on the insole 30 and located with respect to the positions of the base magnet elements 40 and the medicine unit 60.

As shown in FIGS. 1, 2, 4, and 5, the medicine receiving cavity 16 is in circular groove shape and the medicine unit 60 is circularly shaped and sized to fittingly engage in the medicine receiving cavity 16. Adhesive may be applied in the medicine receiving cavity 16 to affix the medicine unit 60 in position. Referring to FIGS. 4 and 5, the medicine unit 60 comprises a circular disc like seat body 61 which has a top side providing a receiving groove 611 and a bottom side forming a magnet groove 612 to fittingly receive the bottom magnet element 70 therein, a shield net 62 with ventilation meshes thereon being placed on top of the seat body 61 to cover the receiving groove 611 to define a receiving chamber 63 between the seat body 61 and the shield net 62 for receiving a medicine layer 64 therein, and a holding ring 65 adapted to fasten the shield net 62 on top of the seat body 61 by clipping on a periphery edge of the seat body 61 so as to hold a circumferential edge of the shield net 62 on the periphery edge of the seat body 61.

As shown in FIG. 5 the medicine layer 64 is made of Chinese medical herb powder. It can also be made in tablet form as shown in FIGS. 6A and 6B. However, no matter the medicine layer 64 is in powder or tablet form, it must contains volatile content.

As shown in FIGS. 1, 2, 6A, and 6B, an alternative mode of the medicine unit 60' is also employed in the present embodiment. The alternative medicine unit 60' is adapted to sit in an additional medicine receiving cavity 16' which is preferably formed at a middle position of the sole 10 with respect to a portion between the first metatarsus and the fifth metatarsus of the wearer's foot. The alternative medicine unit 60' comprises a medicine housing 61' made of elastic material such as rubber or plastic, which has an interior receiving chamber 63' to receive a medicine layer 64' of medicine tablet or powder therein. A volatile slit 65' is formed on a top surface of the medicine housing 61', as shown in FIG. 6A.

As shown in FIG. 2, the additional medicine receiving cavity 16' further has a magnet groove 161' indented thereon to receive an additional bottom magnet element 70'. Referring to FIGS. 2, 6A and 6B, since the alternative medicine unit 60' is placed on top of the additional bottom magnet element 70' and just located at a bendable portion of the sole 10 where the metatarsus portion of the wearer's foot sitting thereon, when the wearer walks, the alternative medicine unit 60' will be bent and the volatile slit 65' will be pressed to form a volatilization opening. Therefore, medicine will be volatilized through that opened volatile slit 65' every time when the wearer bends his or her foot while walking.

Figure 3:
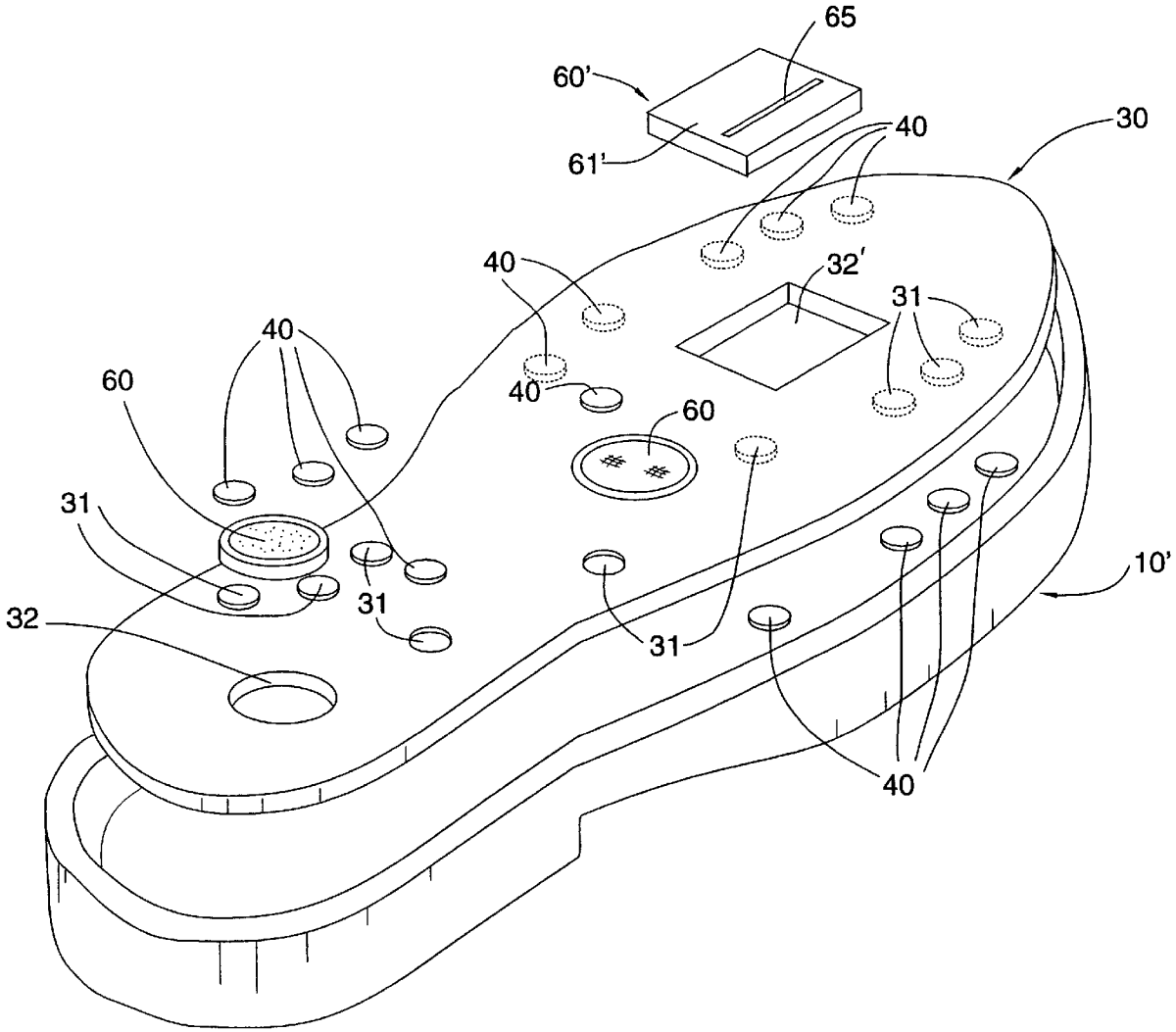
FIG. 3 is an alternative mode of the above preferred embodiment of the present invention.

Referring to FIG. 3, an alternative mode of the health care shoe according to the preferred embodiment of the present invention is illustrated, wherein a modified insole 30' is used to substitute the insole 30 as shown in FIGS. 1 and 2. As shown in FIG. 3, the sole 10' has no magnet cavity or medicine receiving cavity provided. However, the modified insole 30' has a plurality of magnet cavities 31 and at least a medicine receiving cavity 32 thereon to respectively receive the base magnet elements 40 and the medicine unit 60 and/or 60'. As shown in FIG. 3, some magnet cavities 31 are provided on the bottom side of the modified insole 30' so that the base magnet elements 40 can be attached below the modified insole 30'. Moreover, an additional medicine receiving cavity 32' is formed on a middle portion of the modified insole 32' for receiving the alternative medicine unit 60' as illustrated in FIGS. 6A and 6B.

According to the present embodiment, as shown in FIGS. 1 and 3, there is a suggested specific way to distribute the magnet elements 40, 50, 70 and the medicine unit 60 and 60' corresponding to the oriental medical science. On the vamp piece 21 of the shoe body 20, with respect to the area between an upper position extended from the first phalange to the fifth phalange and a lower position extended from the first metatarsus to the fifth metatarsus of the wearer's foot, six of the upper magnet elements 50 are evenly arranged in three roles, wherein a transversal space of 25 mm and a longitudinal space of 30 mm are provided between each of the six upper magnet elements 50.

On the sole 10 or the insole 30', two of the medicine units 60 and one alternative medicine unit 60' is provided according to the present embodiment, wherein the alternative medicine unit 60' is positioned at the bendable middle portion of the sole 10 or the insole 30', with respect to the area between the first metatarsus and the fifth metatarsus of the wearer's foot. One of the two medicine units 60 is positioned at a middle portion of the sole 10 or the insole 30', with respect to the area between the wedge bones and the metatarsus of the wearer's foot. Another medicine unit 60 is positioned at a rear portion of the sole 10 or the insole 30', with respect to the calcaneum of the wearer's foot.

Along the inner side piece 22 of the shoe body 20, with respect to the area extended between the fourth, fifth metatarsus and the calcaneum of the wearer's foot, six of the upper magnet elements 50 each having a diameter of 8 mm and a thickness of 2 mm are distributed there. Along the outer side piece 23, with respect to the area extended between the first metatarsus and the calcaneum of the wearer's foot, four of the upper magnet elements 50 each having a diameter of 8 mm and a thickness of 2 mm are distributed there.

Along a front segment of an inner edge of the sole 10 or the insole 30', three of the base magnet elements 40 each having a diameter of 10 mm and a thickness of 4 mm are positioned with respect to the area between the first metatarsus and the first phalange of the wearer's foot, wherein a space of 15 to 20 mm is provided between each of the three base magnet elements. Similarly, along a front segment of an outer edge of the sole mm and a thickness of 4 mm are positioned with respect to the area between the fifth metatarsus and the fifth phalange of the wearer's foot, wherein a space of 15 to 20 mm is provided between each of the three base magnet elements.

Along a middle segment of the inner edge of the sole 10 or the insole 30', two of the base magnet elements 40 each having a diameter of 20 mm and a thickness of 3 mm are positioned with respect to a portion near the first metatarsus of the wearer's foot, and has a space of 15 to 20 mm therebetween. Similarly, along a rear segment of the inner edge of the sole 10 or the insole 30', three base magnet elements 40 each having a diameter of 10 mm and a thickness of 4 mm are positioned with respect to the heel area of the wearer's foot.

With respect to the area extended from the fifth metatarsus to the calcaneum, along the outer edge of the sole 10 or the insole 30', three of the base magnet elements 40 each having a diameter of 20 mm and a thickness of 3 mm is positioned with a space of 30 to 35 mm between each other.

As shown in FIGS. 2, 5 and 7, according to the present invention, the upper magnet elements 50 are arranged to position above the base magnet elements 40 located along the inner and outer edges of the sole 10 or the insole 30'. Therefore, magnetic field will flow between the upper magnet elements 50 and the respective base magnetic elements 40. Moreover, the upper magnet elements 50 embedded inside the two side pieces of the shoe body 20 also provide transversal magnetic field penetrating through the heel and tarsus portion of the wearer's foot. In other words, magnetic field is forced to penetrate the wearer's foot, that not only can enhance the blood circulation and metabolism of the foot, but also can enhance the permeability of the medicine volatilized from the medicine units 60 and 60' into the wearer's foot.

As shown in FIGS. 1 and 2, the health care shoe of the present invention may further comprises a decorative button 80 affixed on the vamp piece 21 of the shoe body 20, wherein a magnet element 81 is engaged thereunder to provide enhanced magnetic field.

What is claimed is:

1. A health care shoe, comprising:

a sole having a plurality of magnet cavities specifically indented and distributed on an inner surface thereof and at least a medicine receiving cavity having at least a medicine unit received therein, wherein said medicine unit comprises a medicine layer therein and a bottom magnet element positioned thereunder so as to produce magnetic field around said medicine unit:

a shoe body rigidly attached on top of said sole to define a foot chamber between said shoe body and said sole;

a plurality of base magnet elements fittingly received in said magnet cavities respectively provided on said sole; and a plurality of upper magnet elements embedded inside said shoe body with respect to said positions of said base magnet elements, wherein said upper magnet elements are arranged to enable magnetic fields flowing between said base magnet elements and said upper magnet elements.

2. A health care shoe, as recited in claim 1, wherein said plurality of magnet cavities specifically indented and distributed on an inner surface of said sole, each of said magnet cavities is in circular shape and each of said base magnets is shaped and sized fittingly to be received in said respective magnet cavity, wherein glue is applied to firmly stick said base magnet elements in said magnet cavities respectively.

3. A health care shoe, as recited in claim 2, wherein said shoe body comprises a vamp piece and two side pieces which are rigidly attached on top of said sole to define a foot chamber between said shoe body and said sole, and that said upper magnet elements are embedded inside said vamp piece and said side pieces of said shoe body with respect to said base magnet elements located on said sole, wherein said vamp piece and said side pieces each comprising a leather surface and an interior lining adhered together are sewed together to form said shoe body, and said plurality of upper magnet elements are placed between said leather surface and said interior lining of said shoe body, moreover each of said upper magnet elements is glued to said interior lining of said shoe body.

4. A health care shoe, as recited in claim 3, wherein said medicine unit comprises a seat body which has a top side providing a receiving groove and a bottom side forming a magnet groove to fittingly receive said bottom magnet element therein, a shield net with ventilation meshes thereon being placed on top of said seat body to cover said receiving groove to define a receiving chamber between said seat body and said shield net for receiving a medicine layer therein, and a holding ring adapted to fasten said shield net on top of said seat body by clipping on a periphery edge of said seat body so as to hold a circumferential edge of said shield net on said periphery edge of said seat body, wherein said medicine receiving cavity is in circular groove shape and said medicine unit is circularly shaped and sized to fittingly engage in said medicine receiving cavity, and that adhesive is applied in said medicine receiving cavity to affix said medicine unit in position.

5. A health care shoe, as recited in claim 4, further comprising an alternative medicine unit adapted to sit in an additional medicine receiving cavity which is formed at a middle position of said sole, said alternative medicine unit comprising a medicine housing made of elastic material, which has an interior receiving chamber to receive a medicine layer, and a volatile slit formed on a top surface of said medicine housing, wherein said additional medicine receiving cavity further has a magnet groove indented thereon to receive an additional bottom magnet element.

6. A health care shoe, as recited in claim 3, wherein said medicine unit comprises a medicine housing made of elastic material, which has an interior receiving chamber to receive a medicine layer, and a volatile slit formed on a top surface of said medicine housing, and that said medicine receiving cavity further has a magnet groove indented thereon to receive said bottom magnet element.

7. A health care shoe, as recited in claim 2, wherein said medicine unit comprises a seat body which has a top side providing a receiving groove and a bottom side forming a magnet groove to fittingly receive said bottom magnet element therein, a shield net with ventilation meshes thereon being placed on top of said seat body to cover said receiving groove to define a receiving chamber between said seat body and said shield net for receiving a medicine layer therein, and a holding ring adapted to fasten said shield net on top of said seat body by clipping on a periphery edge of said seat body so as to hold a circumferential edge of said shield net on said periphery edge of said seat body.

8. A health care shoe, as recited in claim 7, further comprising an alternative medicine unit adapted to sit in an additional medicine receiving cavity which is formed at a middle position of said sole, said alternative medicine unit comprising a medicine housing made of elastic material, which has an interior receiving chamber to receive a medicine layer, and a volatile slit formed on a top surface of said medicine housing, wherein said additional medicine receiving cavity further has a magnet groove indented thereon to receive an additional bottom magnet element.

9. A health care shoe, as recited in claim 2, wherein said medicine unit comprises a medicine housing made of elastic material, which has an interior receiving chamber to receive a medicine layer, and a volatile slit formed on a top surface of said medicine housing, and that said medicine receiving cavity further has a magnet groove indented thereon to receive said bottom magnet element.

10. A health care shoe, as recited in claim 1, wherein said shoe body comprises a vamp piece and two side pieces which are rigidly attached on top of said sole to define a foot chamber between said shoe body and said sole, and that said upper magnet elements are embedded inside said vamp piece and said side pieces of said shoe body with respect to said base magnet elements located on said sole, wherein said vamp piece and said side pieces each comprising a leather surface and an interior lining adhered together are sewed together to form said shoe body, and said plurality of upper magnet elements are placed between said leather surface and said interior lining of said shoe body, moreover each of said upper magnet elements is glued to said interior lining of said shoe body.

11. A health care shoe, as recited in claim 1, wherein said medicine unit comprises a seat body which has a top side providing a receiving groove and a bottom side forming a magnet groove to fittingly receive said bottom magnet element therein, a shield net with ventilation meshes thereon being placed on top of said seat body to cover said receiving groove to define a receiving chamber between said seat body and said shield net for receiving a medicine layer therein, and a holding ring adapted to fasten said shield net on top of said seat body by clipping on a periphery edge of said seat body so as to hold a circumferential edge of said shield net on said periphery edge of said seat body.

12. A health care shoe, as recited in claim 11, further comprising an alternative medicine unit adapted to sit in an additional medicine receiving cavity which is formed at a middle position of said sole, said alternative medicine unit comprising a medicine housing made of elastic material, which has an interior receiving chamber to receive a medicine layer, and a volatile slit formed on a top surface of said medicine housing.

13. A health care shoe, as recited in claim 12, wherein said additional medicine receiving cavity further has a magnet groove indented thereon to receive an additional bottom magnet element.

14. A health care shoe, as recited in claim 1, wherein said medicine unit comprises a medicine housing made of elastic material, which has an interior receiving chamber to receive a medicine layer, and a volatile slit formed on a top surface of said medicine housing, and that said medicine receiving cavity further has a magnet groove indented thereon to receive said bottom magnet element.

15. A health care shoe, as recited in claim 1, further comprising an insole placed on said sole inside said foot chamber, wherein a plurality of small ventilators are formed on said insole and located with respect to said base magnet elements and said medicine unit.

16. A health care shoe, comprising:

a sole having a plurality of magnet cavities specifically indented and distributed on an inner surface thereof, wherein a front half of said sole forms a ventilation groove and provides a plurality of air ventilation holes distributed on said ventilation groove, each of said air holes having an enlarged base end, said sole further comprising an elastic ventilation pad which has a plurality of ventilation holes thereon and is made of water resistant rubber material, said elastic ventilation pad being shaped and sized to fittedly attached in said ventilation groove;

a shoe body rigidly attached on top of said sole to define a foot chamber between said shoe body and said sole;

a plurality of base magnet elements fittingly received in said magnet cavities respectively provided on said sole; and a plurality of upper magnet elements embedded inside said shoe body with respect to said positions of said base magnet elements, wherein said upper magnet elements are arranged to enable magnetic fields flowing between said base magnet elements and said upper magnet elements.

* * * * *